US008739756B2

(12) United States Patent
Hineiti et al.

(10) Patent No.: US 8,739,756 B2
(45) Date of Patent: Jun. 3, 2014

(54) ENGINE ASSEMBLY WITH ENGINE BLOCK-INTEGRATED COOLING SYSTEM

(75) Inventors: Naser I. Hineiti, Novi, MI (US); Dan L. Alden, Howell, MI (US); Akram R. Zahdeh, Rochester Hills, MI (US); Brian D. Kaminski, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 264 days.

(21) Appl. No.: 13/069,461

(22) Filed: Mar. 23, 2011

(65) Prior Publication Data

US 2012/0240880 A1 Sep. 27, 2012

(51) Int. Cl.

| | |
|---|---|
| ***F02B 75/22*** | (2006.01) |
| ***F02F 1/10*** | (2006.01) |
| ***F01P 3/02*** | (2006.01) |

(52) U.S. Cl.
USPC ..... 123/195 R; 123/41.33; 123/41.31; 123/41.42; 123/193.1; 123/41.29

(58) Field of Classification Search
USPC ..... 123/41.33, 195 R, 193.1, 41.42, 41.29, 123/41.31
See application file for complete search history.

(56) References Cited

U.S. PATENT DOCUMENTS

| | | | | |
|---|---|---|---|---|
| 6,101,994 | A * | 8/2000 | Ichikawa | 123/195 R |
| 6,571,763 | B1 * | 6/2003 | Bakker | 123/195 R |
| 2005/0172917 | A1 * | 8/2005 | Betsch et al. | 123/41.82 R |
| 2009/0301414 | A1 | 12/2009 | Netsu | |

FOREIGN PATENT DOCUMENTS

| | | | |
|---|---|---|---|
| CN | 201382726 | Y | 1/2010 |
| JP | 08177440 | A | 7/1996 |
| JP | 2002070641 | A | 3/2002 |
| JP | 2002227648 | A | 8/2002 |

* cited by examiner

*Primary Examiner* — Lindsay Low
*Assistant Examiner* — Kevin Lathers
(74) *Attorney, Agent, or Firm* — Quinn Law Group, PLLC

(57) ABSTRACT

A cooling system for an engine assembly includes an engine block that defines a coolant flow passage configured to carry coolant through the engine block. The engine block also defines an oil flow passage configured to carry lubricating oil through the engine block. The oil flow passage at least partially surrounds the coolant flow passage and is sufficiently adjacent to the coolant flow passage so that the lubricating oil flowing in the oil flow passage is cooled by the coolant flowing in the coolant flow passage by heat transfer through the engine block. The engine block may define ridges along the coolant flow passage that increase a surface area of the coolant flow passage to increase heat transfer capability. The engine block may define two such coolant flow passages, a first and a second coolant flow passage, positioned so that the oil flow passage passes between the coolant flow passages.

11 Claims, 2 Drawing Sheets

ENGINE ASSEMBLY WITH ENGINE BLOCK-INTEGRATED COOLING SYSTEM

TECHNICAL FIELD

The invention relates to a cooling system for an engine assembly.

BACKGROUND

Vehicle engines can reach high temperatures, especially in certain portions of the engine, such as around the cylinders. Lubrication and cooling of the engine is required to extend the life and improve the performance of the engine. Typically, an engine cooling system is largely external to the engine block, and requires associated packaging space in the vehicle. Cooling systems that target specific high-temperature areas of the engine assembly introduce slightly higher temperatures into the lubricating system.

SUMMARY

A cooling system for an engine assembly includes an engine block that defines a coolant flow passage configured to carry coolant from a coolant source through the engine block. The engine block also defines an oil flow passage configured to carry lubricating oil through the portion of the engine block. The oil flow passage at least partially surrounds the coolant flow passage and is sufficiently adjacent to the coolant flow passage so that the lubricating oil flowing in the oil flow passage is cooled by the coolant flowing in the coolant flow passage by heat transfer through the engine block. The engine block may define ridges along the coolant flow passage that increase a surface area of the coolant flow passage to increase heat transfer capability. The engine block may define two such coolant flow passages, a first and a second coolant flow passage, positioned so that the oil flow passage passes between the two coolant flow passages. A portion of the oil flow passage may be configured to function as a reservoir to temporarily hold at least some of the oil that has flowed past the first coolant passage prior to flowing between the first and the second coolant flow passages. The first coolant flow passage may direct coolant to the cylinder head while the second coolant flow passage may direct coolant around the cylinder bore.

In one embodiment, the engine assembly includes a cylinder head connected to the engine block. The oil in the oil flow passage flows from the cylinder head to an oil sump. A coolant pump is mounted to the engine block and the coolant flow passages direct coolant from the coolant pump through the engine block for cooling the engine. Coolant flow from an outlet of the pump is split between the first and the second coolant flow passages. The first coolant flow passage directs coolant around the cylinder bores and the second coolant flow passage directs coolant flow to the cylinder head. At least one of the coolant flow passages is sufficiently adjacent the oil flow passage such that coolant flowing in the oil flow passage cools the oil flowing in the adjacent oil flow passage by heat transfer through the engine block.

Accordingly, the cooling system allows removal of thermal energy from the lubricating system of the engine assembly at minimal cost and small packaging requirements. Better engine cooling results in better engine combustion, avoids knock and pre-ignition problems, and can lead to better engine performance and fuel economy.

The above features and advantages and other features and advantages of the present invention are readily apparent from the following detailed description of the best modes for carrying out the invention when taken in connection with the accompanying drawings.

DETAILED DESCRIPTION

Figure 1:
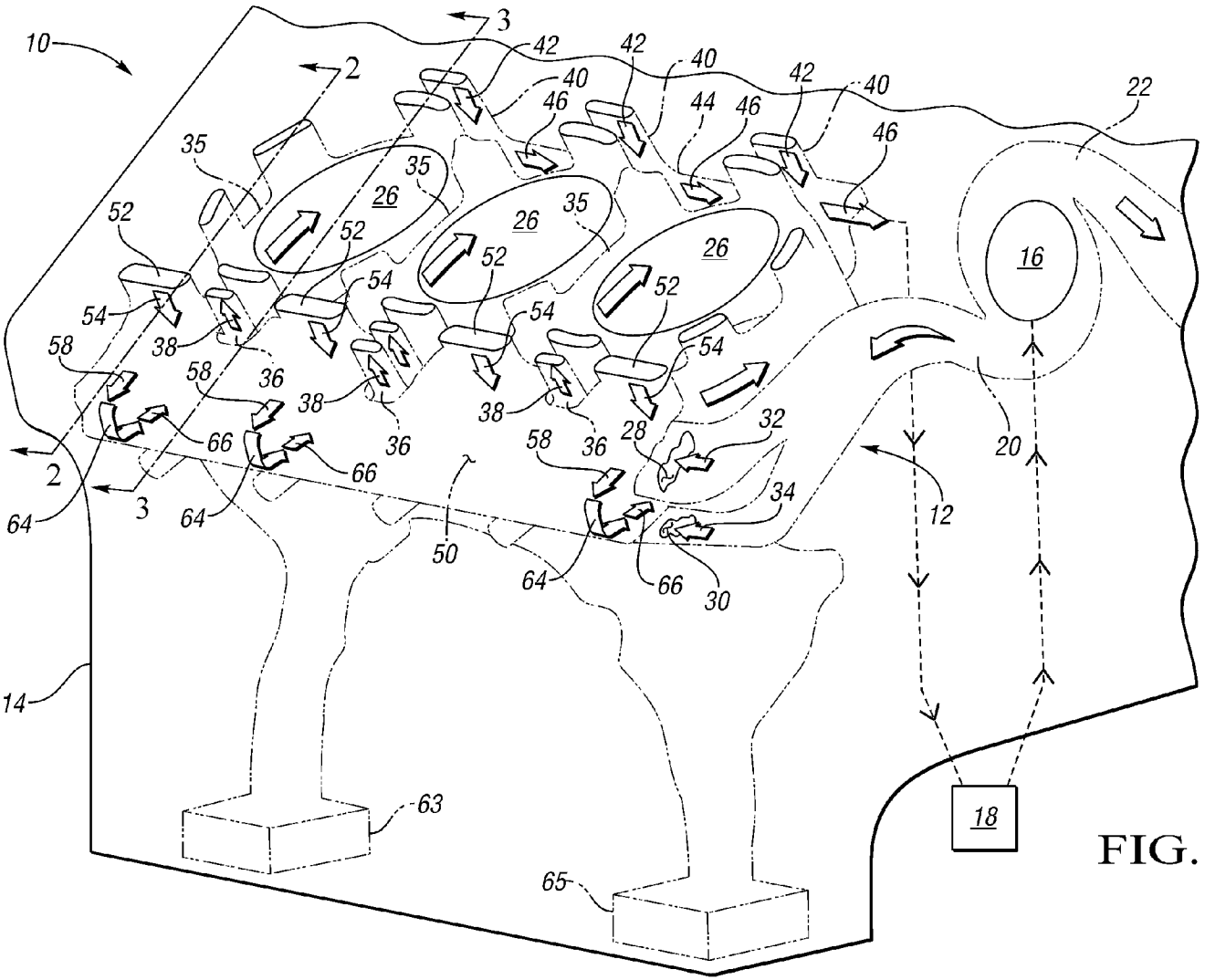
FIG. 1 is a schematic perspective illustration in fragmentary view of an engine assembly with a cooling system including coolant flow passages and oil flow passages indicated in phantom.

Referring to the drawings, wherein like reference numbers refer to like components throughout the several views, FIG. 1 shows an engine assembly 10 with a cooling system 12. The engine assembly 10 includes an engine block 14. Portions of the cooling system 12 are integrated into the engine block 14 in a manner that reduces componentry, mass and packaging space requirements, and increases the cooling capability of the cooling system 12.

Specifically, the cooling system 12 includes a dual outlet pump 16 mounted to the engine block 14. The pump 16 is in fluid communication with a radiator 18, mounted externally to the engine assembly 10. The radiator 18 is configured to provide air cooling of coolant flowing through the cooling system 12. For example, the radiator 18 may be mounted to a vehicle forward of the engine assembly 10. The coolant may be 50% water and 50% glycol, or any other liquid coolant appropriate for cooling the engine assembly 10. After flowing through the radiator 18, the pump 16 directs the coolant through a first pump outlet passage 20 and a second pump outlet passage 22. The first pump outlet passage 20 directs the coolant to cool a first portion of the engine assembly 10, and the second pump outlet passage 22 directs the coolant to cool a second portion of the engine assembly 10. In this embodiment, the engine assembly 10 is a V-6 engine. The first pump outlet passage 20 directs coolant for cooling a portion of a cylinder head 24 (shown in phantom in FIG. 3) above three of the six cylinder bores 26, and the second pump outlet passage 22 directs coolant for cooling a portion of the cylinder head 24 above the other three cylinder bores (not shown, but being a mirror image of the cylinder bores 26 that are shown, as is understood by those skilled in the art). Those skilled in the art will understand various ways of attaching the cylinder head 24 to the engine block 14. Accordingly, the cooling system 12 is discussed with respect to the first pump outlet passage 20. The cooling system 12 is largely identical in the other half of the V-shaped engine block 14, and coolant is directed to that portion by the second pump outlet passage 22.

Figure 2:
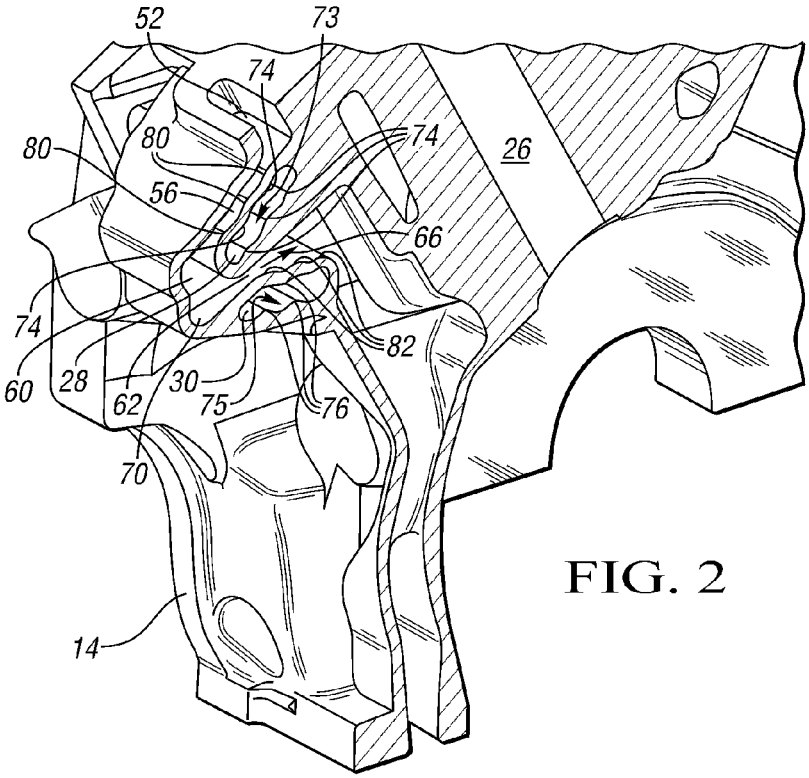
FIG. 2 is a schematic perspective cross-sectional illustration in fragmentary view of the engine assembly of FIG. 1 taken at the lines 2-2.
Figure 3:
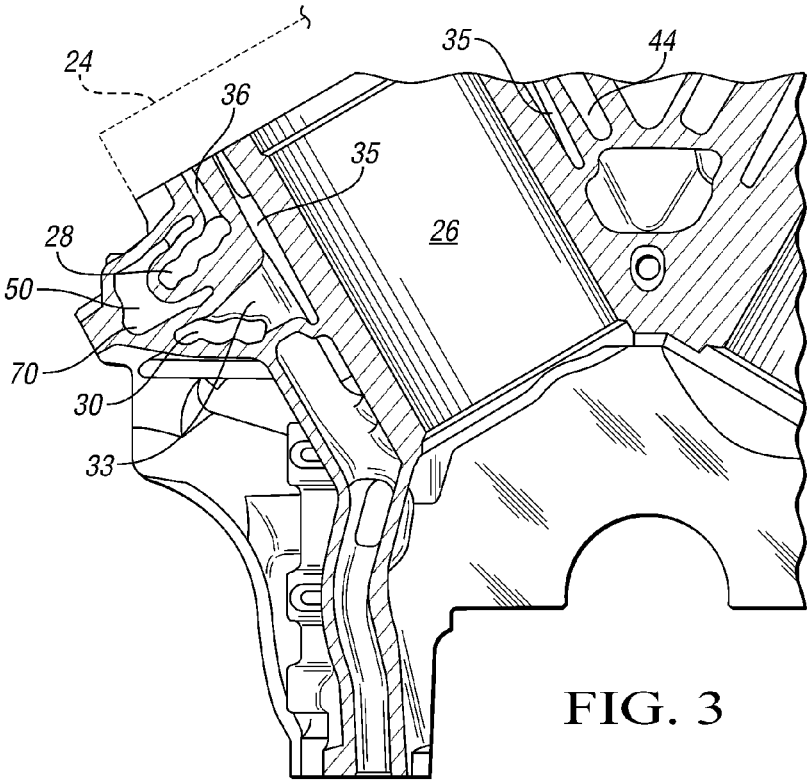
FIG. 3 is a schematic perspective cross-sectional illustration in fragmentary view of the engine assembly of FIG. 1 taken at the lines 3-3.

The engine block 14 is formed with first and second coolant flow passages 28, 30, respectively. The first pump outlet passage 20 is in fluid communication with the first and second coolant flow passages 28, 30 so that coolant flow is split between the passages 28, 30 in some proportion which need not be equal. The first and second coolant flow passages 28, 30 extend generally parallel to one another along the length of the engine block 14, as indicated in FIGS. 2 and 3. Flow through the first and second coolant flow passages 28, 30 is generally in the direction of arrows 32, 34, which is in the direction along the length of the engine block 14. Additionally, branch passages 36 extend at various points along the length of the first coolant flow passage 28 and allow the coolant to flow in the direction of arrows 38 into the cylinder head 24, of FIG. 2. After cooling portions of the cylinder head 24, the coolant is then directed through branch passages 40 in the direction of flow 42, through an exit flow passage 44 in the direction of flow 46, and through additional passages, both in and external to the engine block 14, back to the radiator 18 to begin the cooling circuit again.

As shown in FIG. 3, branch passages 33 extend at various points along the length of the second coolant flow passage 30 to allow coolant to flow through coolant jackets 35 that circumferentially surround the cylinder bores 26. There are three branch passages 33, only one of which is shown in FIG. 3, spaced along the coolant flow passage 30 to provide fluid communication to the coolant jackets 35. Coolant flows through the coolant jackets 35 to cool the cylinder bores 26, and is then emptied into the exit flow passage 44 to exit to the radiator 18.

The coolant flow passages 28, 30 are adjacent to an oil flow passage 50 formed in the engine block 14. The oil flow passage 50 carries oil used in cooling and lubricating various portions of the cylinder head 24 and the engine block 14. Specifically, as shown in FIG. 1, after lubricating components in the cylinder head 24, oil flows into inlet passages 52 in the oil flow passage 50 in the direction of arrows 54. As shown in FIG. 2, a first portion 56 of the oil flow passage 50 passes over the first coolant flow passage 28 with coolant flowing in the direction of arrows 58. The oil flow passage 50 then turns at an elbow portion 60 shown in FIG. 2 and includes a second portion 62 that extends between the first and second coolant flow passages 28, 30. Flow of the coolant through the elbow portion 60 is indicated by arrows 64 in FIG. 1. Flow of the coolant through the second portion 62 is in the direction of arrows 66 (shown in FIG. 2), which is generally perpendicular to the direction of flow of the coolant through the first and second coolant flow passages 28, 30 indicated by arrows 32, 34 of FIG. 1. Because the oil flow passage 50 passes over the first coolant flow passage 28 and then between the first coolant flow passage 28 and the second coolant flow passage 30, more heat is extracted from the oil in the oil flow passage 50 than if the oil flow passage 50 was not surrounded by the coolant flow passages 28, 30. Furthermore, the thickness of the engine block 14 separating the coolant flow passage 28, 30 and the oil flow passage 50 is sufficiently small to allow heat transfer to take place through the block 14.

The oil flow passage 50 is formed with other features that increase the cooling of the engine assembly 10 by slowing the flow of oil through the oil flow passage 50, allowing more time for the cooling effect of the coolant flow passages 28, 30 to affect the oil. Specifically, the oil flow passage 50 has a reservoir 70 at a low point of the passage 50. The reservoir 70 may also be referred to as a valley or a pooling area. Gravity causes at least some of the oil flowing through the oil flow passage 50 to temporarily settle in the reservoir 70 and, depending on the speed of oil flow, the oil may temporarily remain in the reservoir 70 before flowing out again through the second portion 62. This also slows the flow of oil, allowing greater heat extraction by the coolant flowing in passages 28, 30. Oil then flows from the second portion 62 downward to portions 63, 65 of a sump. The portions 63, 65 of the sump are interconnected by other passages (not shown) and in fluid communication with an oil pump that pumps the oil back to oil flow passage 50.

Referring to FIG. 2, the engine block 14 has a surface 73 defining the first coolant flow passage 28. The surface 73 is formed with ridges 74 that increase the surface area of the coolant flow passage 28 as compared to a passage without ridges. Similarly, the engine block 14 has a surface 75 defining the second coolant flow passage 30. The surface 75 is formed with ridges 76 that increase the surface area of the coolant flow passage 30 as compared to a passage without ridges. By increasing the surface area of the passages 28, 30, the ridges 74, 76 help to increase heat transfer between the coolant and the oil through the portion of the block 14 between the coolant flow passages 28, 30 and the oil flow passage 50.

The engine block 14 also forms ridges 80 in the first portion 56 of the oil flow passage 50 and ridges 82 in the second portion 62 of the oil flow passage 50. The ridges 80 and 82 are perpendicular to the direction of flow of the oil through the portions 56, 62, and therefore act as obstacles to help slow the flow of oil. Because the oil flow is slowed, greater heat transfer can occur through the portions of the block 14 separating the oil flow passage 50 from the coolant flow passage 28, 30.

While the best modes for carrying out the invention have been described in detail, those familiar with the art to which this invention relates will recognize various alternative designs and embodiments for practicing the invention within the scope of the appended claims.

The invention claimed is:

1. A cooling system for an engine assembly comprising:

a generally V-shaped engine block having a first and a second row of cylinder bores and a valley between the rows of cylinder bores; wherein the engine block defines a first coolant flow passage and a second coolant flow passage generally parallel with the first coolant flow passage and both extending along a length of the engine block past multiple ones of the cylinder bores of the first row and configured to carry coolant through the engine block;

wherein the engine block defines an oil flow passage configured to carry lubricating oil through the engine block; wherein the oil flow passage at least partially surrounds the first and second coolant flow passages and is sufficiently adjacent to the coolant flow passage such that the lubricating oil flowing in the oil flow passage is cooled by the coolant flowing in the coolant flow passage by heat transfer through the engine block;

wherein the oil flow passage has a first portion generally above the first coolant passage, a second portion generally below the first coolant passage, and an elbow portion connecting the first portion and the second portion; wherein the elbow portion is positioned in the engine block outside the valley; and wherein the elbow portion of the oil flow passage is configured to function as a reservoir to hold at least some of the oil that has flowed through the first portion and past the first coolant flow passage prior to flowing in the second portion between the first and the second coolant flow passages.

2. The cooling system of claim 1, wherein the coolant flow passages and the oil flow passage extend so that a direction of flow of coolant in the coolant flow passages along the length of the engine block is generally perpendicular to a direction of flow of lubricating oil in the oil flow passage.

3. The cooling system of claim 1, wherein the engine block defines a series of ridges along the coolant flow passages that are configured to increase a surface area of the coolant flow passages.

4. The cooling system of claim 1, wherein the engine block defines a series of ridges along a portion of the oil flow passage that is adjacent to the coolant flow passages so that oil in the portion of the oil flow passage flows over multiple ones of the ridges to slow oil flow past the coolant flow passages.

5. An engine assembly comprising:

a cylinder head;

a generally V-shaped engine block connected to the cylinder head having a first and a second row of cylinder bores and a valley between the rows of cylinder bores, and defining an oil flow passage containing oil flowing from the cylinder head to an oil sump; a coolant pump mounted to the engine block; wherein the engine block defines coolant flow passages that direct coolant from the coolant pump through the engine block for cooling the engine; wherein the coolant flow passages include a first coolant flow passage and a second coolant flow passage generally parallel with one another and each extending along a length of the engine block past multiple ones of the cylinder bores of the first row of cylinder bores;

wherein the first and second coolant flow passages are sufficiently adjacent to the oil flow passage such that the coolant flowing in the first and second coolant flow passages cools the oil flowing in the adjacent oil flow passage by heat transfer through the engine block;

wherein the oil flow passage has a first portion generally above the first coolant passage, a second portion generally below the first coolant passage, and an elbow portion connecting the first portion and the second portion; wherein the elbow portion is positioned in the engine block outside of the valley and wherein the elbow portion is configured to function as a reservoir to hold at least some of the oil that has flowed through the first portion and past the first coolant flow passage prior to flowing in the second portion between the first and the second coolant flow passages.

6. The engine assembly of claim 5, wherein coolant flow from an outlet of the pump is split between the first and second coolant flow passages; and wherein the first coolant flow passage directs coolant around the cylinder bores of the first row of cylinder bores and the second coolant flow passage direct coolant flow to the cylinder head.

7. The engine assembly of claim 6, wherein the oil flow passage passes between the first and the second coolant flow passages.

8. The engine assembly of claim 7, wherein a surface of the engine block defining the first coolant flow passage has a series of ridges that are configured to increase a surface area of the engine block between the first portion and the second portion of the oil flow passage.

9. The engine assembly of claim 8, wherein a surface of the engine block defining the first portion and the second portion of the oil flow passage has additional ridges that are configured to slow oil flow in the oil flow passage.

10. A cooling system for an engine assembly comprising:

A generally V-shaped engine block having a first row and a second row of cylinder bores and a valley between the rows of cylinder bores; wherein the engine block defines a first coolant flow passage extending along a length of the engine block past multiple ones of the cylinder bores of the first row of cylinder bores and configured to carry coolant through the engine block;

wherein the engine block defines an oil flow passage configured to carry lubricating oil through the engine block; wherein the oil flow passage at least partially surrounds the first coolant flow passage and is sufficiently adjacent to the first coolant flow passage such that the lubricating oil flowing in the oil flow passage is cooled by the coolant flowing in the first coolant flow passage by heat transfer through the engine block;

wherein the engine block further defines a second coolant flow passage extending past said multiple ones of the cylinder bores of the first row of cylinder bores along the length of the engine block and generally parallel to the first coolant flow passage and positioned so that the oil flow passage passes between the first and the second coolant flow passages;

wherein the first coolant flow passage directs coolant around the cylinder bores of the first row of cylinder bores and the second coolant flow passages direct coolant flow to the cylinder head;

wherein the oil flow passage has a first portion generally above the first coolant passage, a second portion generally below the first coolant passage, and an elbow portion connecting the first portion and the second portion; wherein the elbow portion is positioned in the engine block outside the valley; and wherein the elbow portion is configured to function as a reservoir to hold at least some of the oil that has flowed through the first portion and past the first coolant flow passage prior to flowing in the second portion between the first and the second coolant flow passages.

11. The cooling system of claim 10, wherein the engine block defines a series of ridges along the oil flow passage; wherein the ridges are arranged in a portion of the oil flow passage that is adjacent to the first coolant flow passage and so that oil in the portion of the oil flow passage flows over multiple ones of the ridges to slow oil flow past the first coolant flow passage.

* * * * *